United States Patent [19]

Wang

[11] Patent Number: 4,557,350

[45] Date of Patent: Dec. 10, 1985

[54] FOLDING CHAIR CAPABLE OF CONVERTING INTO STEP LADDER

[76] Inventor: Jung-Hwa Wang, 2nd Fl., No. 54, Huan Ho East Rd., Sec. 3, Yung Ho City, Taipei Hsien, Taiwan

[21] Appl. No.: 713,898

[22] Filed: Mar. 20, 1985

[51] Int. Cl.[4] ..... A47C 13/00; A47C 9/00; A47C 3/18

[52] U.S. Cl. ..... 182/33; 182/125; 297/118

[58] Field of Search ..... 182/33, 33.3, 125; 297/118

[56] References Cited

U.S. PATENT DOCUMENTS

| | | | |
|---|---|---|---|
| 1,596,909 | 8/1926 | Weeks | 182/33.3 |
| 1,831,143 | 11/1931 | Shambaugh | 182/33.3 |
| 2,052,450 | 8/1936 | Cooney | 182/33.3 |
| 2,523,466 | 9/1950 | Greene | 182/33 |
| 2,805,703 | 9/1957 | Wise | 182/33 |
| 3,075,610 | 1/1963 | Lubke | 182/33 |
| 4,440,264 | 4/1984 | Knoke | 182/33 |

FOREIGN PATENT DOCUMENTS

| | | | |
|---|---|---|---|
| 385183 | 12/1932 | United Kingdom | 182/33.3 |

*Primary Examiner*—Reinaldo P. Machado
*Attorney, Agent, or Firm*—Burns, Doane, Swecker & Mathis

[57] ABSTRACT

A folding chair in which two pairs of linkage means are mounted on the opposite sides of a seat having two imbricating seat portions, the two seat portions being disposed one after the other on the same horizontal plane in forming the folding chair with back or the two seat portions being imbricately disposed one above the other on two different horizontal planes in which the uppermost pedal being rested on the top surface of the back, displacement in position of the two seat portions being defined and coupled by a pair of linkages.

5 Claims, 11 Drawing Figures

FOLDING CHAIR CAPABLE OF CONVERTING INTO STEP LADDER

DETAILED DESCRIPTION

The present invention relates to a folding chair serving for multiple use, and more particularly, to a chair readily convertible to a cutty step ladder, where two pairs of linkages are mounted on the opposite sides of a seat having two imbricating seat portions, the two seat portions being disposed one after the other on the same horizontal plane in forming the folding chair with back or the two seat portions being disposed one above the other on two different horizontal planes in which the uppermost step being rested on the top surface of the back, displacement in position of the two seat portions being defined and coupled by a pair of linkages.

Many types and constructions of foldable chair and step stool are known. Although the chair is convenient for use and can be folded with ease, it is however suited for sitting only. On the other hand, the folding step stool is mainly used as a ladder though it may be employed as a stool with or without back. Because such step stool is limited in its construction, the step stool can not be esthetically designed like an ordinary stool.

As the traditional foldable chair and step stool lack a common usefulness, the present invention overcomes the afore-enumerated disadvantages by providing a novel designed folding chair which can be employed for multi-purposes.

It is, therefore, the principal object of the present invention to provide a structure which is convertible to a folding chair with back or to a cutty ladder with few steps.

Another object of the present invention is to provide a multi-purpose furniture suitable for use in household chores, being undifferentiated from the usual folding chair in external appearance and yet easily convertible to a cutty step ladder.

The further object of the present invention is to provide linkages whereby two seat portions can be disposed in a single horizontal plane or in two different planes.

The objects and advantages of the present invention will become apparent from the following detailed description of the preferred embodiment thereof, in connection with the accompanying drawings, in which.

Figure 2:
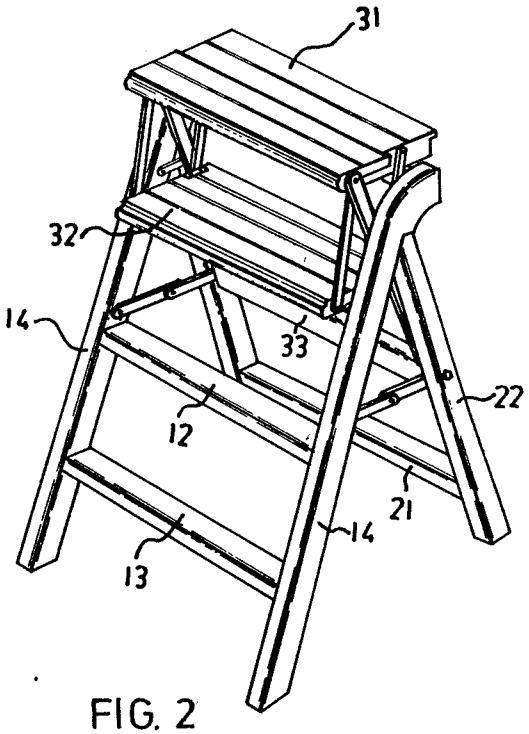
FIG. 2 is a perspective view of a cutty step ladder formed according to the present invention.
Figure 1:
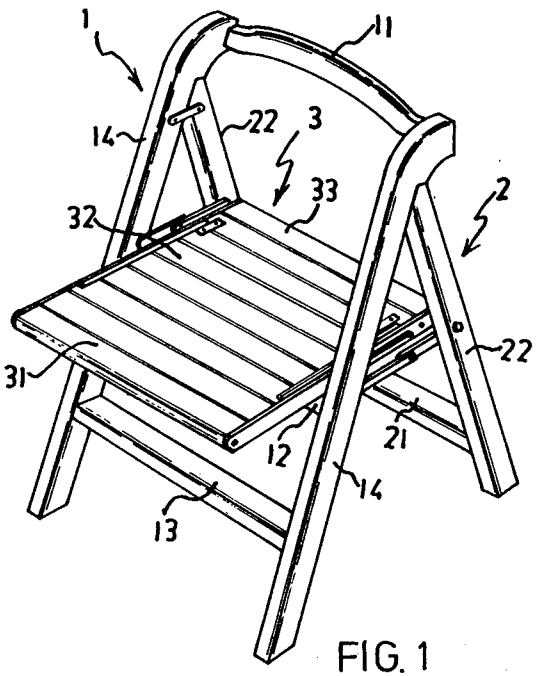
FIG. 1 is a perspective view of a folding chair with bach formed in accordance with the present invention.
Figure 3:
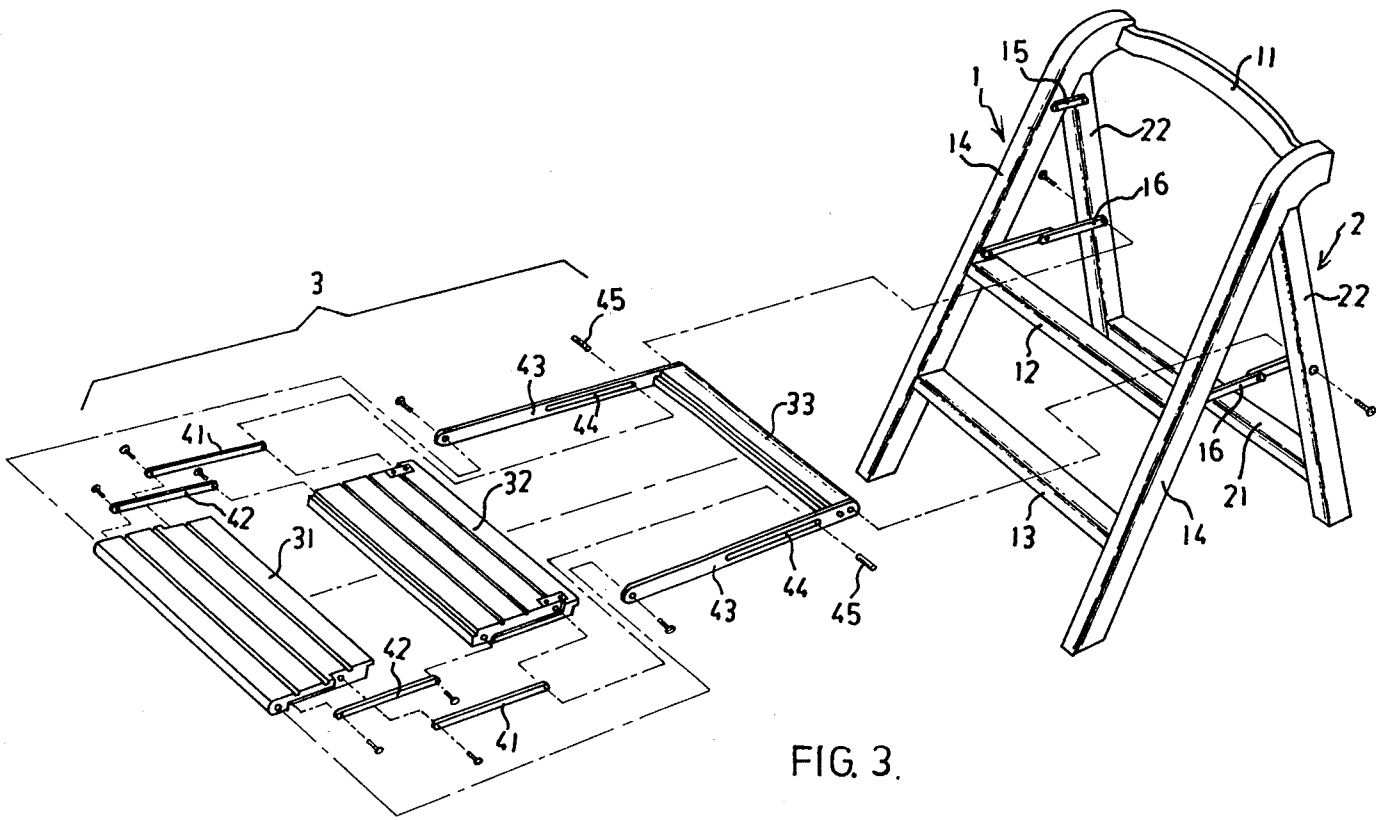
FIG. 3 is an exploded perspective view of the folding chair capable of converting to step ladder of the present invention.

As illustrated in FIGS. 1-3, the folding chair according to the present invention comprises a first frame part 1, a second frame part 2, a seat 3 and linkage means 4. The first frame part 1 comprises two front leg supports 14 having the upper ends thereof being connected by a back rail 11 and the lower end thereof by horizontal stretchers 12, 13, and the second frame part 2 comprises two rear leg supports 22 with upper ends thereof each being pivotally connected to the inner side of the upper end of respective front leg support 14 by a connecting means and the lower ends thereof being connected by a horizontal stretcher 21. The seat 3 includes a front, a middle and a rear seat portions 31, 32, 33, and the linkage means 4 are mounted on either side of the seat 3 on the inner sides of the first and second frame parts 1, 2.

Returning again to FIG. 3, there is shown the first and the second frame parts 1, 2 being pivotally connected at the upper ends thereof by means of a connecting means 15 and at the middle portion thereof on each side by means of a pair of toggle joints 16. It can be appreciated that when the toggle joints 16 are bent towards each other at each side, the second frame parts 2 will fold towards the front about the pivot point of the connecting means 15. Two pairs of parallel connecting means 41, 42 are each pivotally connected to the two sides of the front seat portion 31 and the two sides of the middle seat portion 32 respectively of the seat 3, the opposite ends of the connecting means 41 being pivotally connected one end to the rear section of the front seat portion 31 and the other to the rear section of the middle seat portion 32 while the opposite ends of the connecting means 42 being pivotally connected one end to the front section of the front seat portion 31 and the other to the front section of the middle seat portion 32. On the sides of the seat portions 31, 32, the position of the connecting means 41 is higher than the position of the connecting means 42 and, furthermore, on the opposite ends of the rear seat portion 33 and firmly attached thereto there are a pair of crank arms 43 provided each with a long slot 44. The front terminal ends of the crank arms 43 are pivotally connected each to a front-most end on the opposite sides of the front seat portion 31 while the rear ends thereof are pivotally connected to the middle seat portion 32 on each side by means of a pivot pin 45, the outer end of the pivot pin 45 is disposed within the long slot 44. The opposite ends of the rear seat portion 33 are pivotally connected to the rear leg support 22 of the second frame part 2. In the seat 3, the rear edge of the front seat portion 31, the front and the rear edges of the middle seat portion 32 and the front edge of the rear seat portion 33 are all adapted to be in a corresponding stepped pattern. When the three seat portions are interconnected by the connecting means 41, 42 and the crank arms 43, the rear edge of the front seat portion 31 will be imbricated with the front edge of the middle seat portion 32 and the rear edge of the middle seat portion 32 will be imbricated with the front edge of the rear seat portion 33 such that the top surface of one seat portion will be on the same horizontal plane with those of the other two.

Figure 4:
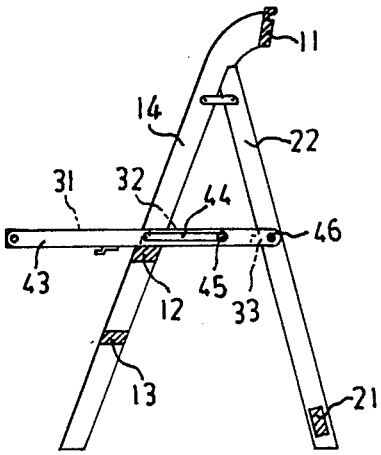
FIG. 4–7, are schematic views showing the operation of the folding chair being converted into a step ladder.

In a folding chair with back of the present invention, the front, the middle and the rear seat portions 31, 32 and 33, as illustrated in FIG. 4, are arranged on a single horizontal plane on the top surface of the transverse stretcher 12, that is, the pivot pin 45 is located at the rear end of the long slot 44.

Figure 5:
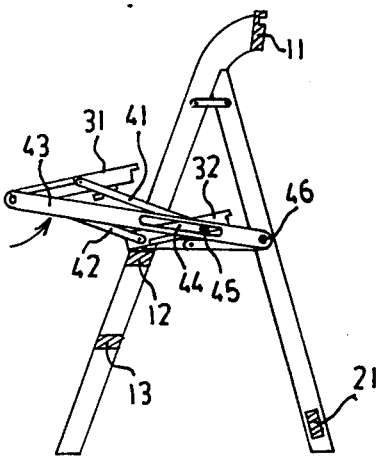
Figure 6:
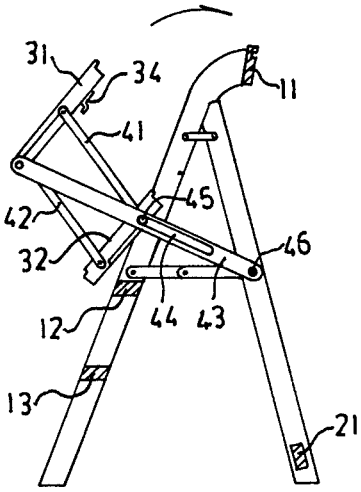
Figure 7:
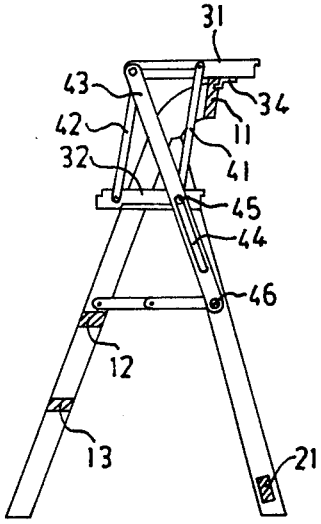

If the folding chair of the present invention is to be converted into a cutty step ladder, the front edge of the front seat portion 31 of the seat 3 is lifted upward and turned forward as illustrated in FIGS. 5–7, whereby the crank arms 43 are rotated in a fan-like fashion about the pivoted centers 46 at the rear ends of the crank arms 43. At this moment, the coupling action of the parallel connecting means 41, 42 forces the rear edges of the front and the middle seat portions 31, 32 to turn forward and upward round in a synchronously parallel manner while the pivot pins 45 are moved to slide within the long slots 44 of the crank arms 43 in from back forward direction, such that the front and the middle seat portions 31, 32 are kept to one another in a parallel condition. When the front seat portion 31 is horizontally disposed on the top surface of the back rail 11 and locked thereto by a fastening means 34, the front seat portion 31 will thus become the uppermost horizontal step, the middle seat portion 32 the next uppermost horizontal step and the transverse stretchers 12, 13 will in turn become the steps of next in altitude.

Figure 8:
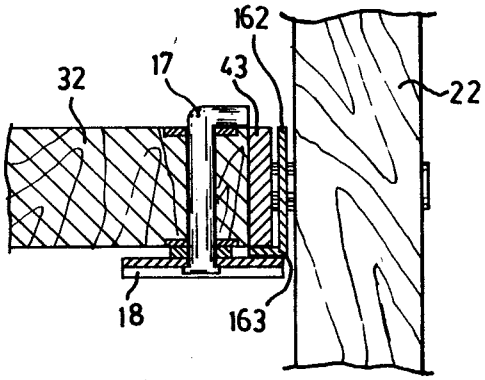
FIG. 8 is a sectional view showing the coupling device for folding of the chair in accordance with the present invention.
Figure 11:
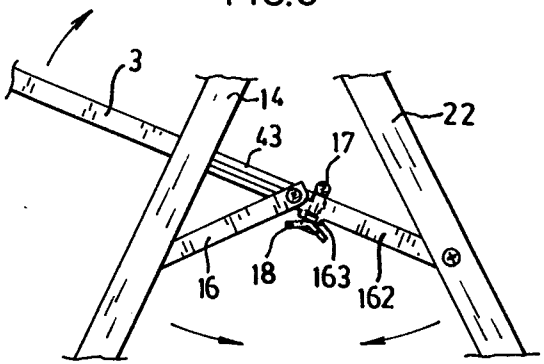
FIG. 11 is a schematic view showing folding of the chair.
Figure 9:
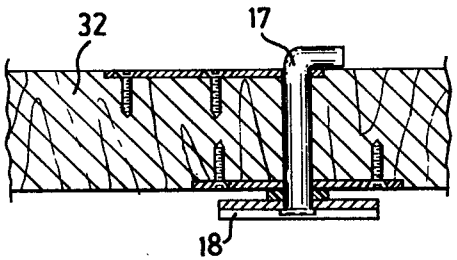
FIG.9 is a side sectional view of FIG. 8.
Figure 10:
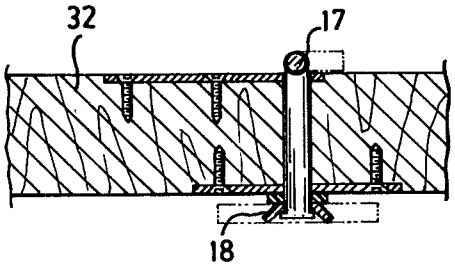
FIG. 10 shows the pivot pin in FIG. 9 being turned an angle of 90°.

Again in order to allow the chair of the instant invention to be capable of folding to a compact depth like an ordinary foldable chair when the chair is in the extended position, the front edge of the seat 3 is simply lifted upward from its horizontal position and towards the direction of the back rail 11. This action will move the two toggle joints 16 on each side of the seat 3 to bend towards each other thereby permitting the front leg support 14 and the rear leg support 22 to approach each other so that the chair will now be in a folded condition. As illustrated in FIG. 8, the middle seat portion 32 of the seat 3 is provided at each side near the edge thereof adjoining to the medial junction of the toggle joints 16 with a pivotal arm 17 passing through that middle seat portion. The lower terminal projecting portion of each pivotal arm 17 is fixedly attached to a rotating means 18 having a longer longitudinal length and a shorter transverse width and rotatable integrally with the pivotal arm 17. The upper projecting portion of the pivotal arm 17 is bent in the same direction as the longitudinal length of the rotating means 18 such that each time when the pivotal arms 17 are turned an angle of 90°, the rotating means 18 at the lower terminal end thereof will thus be made to change on the same vertical plane from the longitudinal length into the transverse width and vice versa (FIGS. 9, 10). One of the toggle joints 162 has the lower edge thereof projected inwardly and extended beneath the crank arm 43 to form a horizontal stop means 163 as shown in FIGS. 8, 11.

In folding the chair of the present invention, each pivotal arm 17 is turned to allow the longitudinal length of the rotating means 18 to rotate into the bottom of the horizontal stop means 163. When the seat 3 is pushed upward, the rotating means 18 will immediately carry and lift the toggle joint 162 upward thereby permitting the toggle joints 161, 162 on each side to bend synchronously. At this moment, the front leg support 14 and the rear leg support 22 approach each other in a synchronous manner till the seat 3 comes to lean against the back rail when the front leg support 14 and the rear leg support 16 lie against each other completely.

It may be conceived from the foregoing that the folding chair according to the present invention at a glance is not much different from a typical folding chair in appearance which is likewise collapsible in a conventional manner. However, it is to be appreciable here that by merely lifting the front edge of the seat upward, the seat can be split into two-stepped parallel pedals and together with the transverse stretchers of the first frame part a cutty ladder with four steps can thus be formed. This chair will not only be easy to manipulate and sturdy in its structure but will also be the most perfect for household use.

I claim:

1. A folding chair capable of converting into a step ladder comprising:

a first frame part having the lower end portion thereof forwardly disposed comprising two front leg supports, a back rail connecting the upper ends of said front leg supports and transverse stretchers connecting the lower ends thereof;

a second frame part having the lower end portions thereof backwardly disposed comprising two rear leg supports having upper ends thereof each being pivotally connected to the inner side of the upper end of each said front leg support and a transverse stretcher connecting the lower ends of said front leg supports;

a seat formed of a front seat portion, a middle seat portion and a rear seat portion having one portion thereof imbricating the next in order;

two sets each including two parallel linkage means having the opposite ends thereof pivotally connected to said front seat portion and middle seat portion respectively of said seat;

two crank arms having the front ends pivotally connected to the opposite sides of the front edge of said seat portion and the rear ends secured to the opposite sides of said rear seat portion of said seat.

2. The folding chair capable of converting into a step ladder according to claim 1 characterized further in that the opposite sides of said rear seat portion of said seat are pivotally connected to the inner sides of said rear leg supports of said second frame part and where said front seat portion imbricates said middle seat portion corresponds to the top surface of said transverse stretcher of said first frame part.

3. The folding chair capable of converting into a step ladder according to claim 1 characterized further in that said front, middle and rear seat portions of said seat are linked one imbricating the other on a horizontal plane by two sets of said parallel linkage means and two crank arms, and can be converted into stepped form within the range of motion of said linkage means and crank arms.

4. The folding chair capable of converting into a step ladder according to claim 1 characterized further in that while the front seat portion of said seat is rested on the top surface of said back rail, the middle seat portion thereof is suspended from below said front seat portion by two sets of said parallel linkage means.

5. The folding chair capable of converting into a step ladder according to claim 1 characterized further in that said front leg supports and rear leg supports are connected on each side by means of a pair of toggle joints disposed outside said seat, the lower edge of one of said toggle joints horizontally extending beneath said seat to form a stop means, that said seat is provided at each outer side thereof in corresponding position with a pivotal arm vertically passing through said seat, said pivotal arms each having the end that passes through the bottom face of said seat attached to an elongate rotating means rotatable integrally with said pivotal arm and having a length reaching into the lower side of said stop means and a width not reaching into the lower side of said stop means, and that when the length of said rotating means is rotated to reach into the lower side of said stop means, the lifting up of said seat will move said toggle joints to bend synchronously.

* * * * *